US009333740B2

(12) United States Patent
Brocker et al.

(10) Patent No.: US 9,333,740 B2
(45) Date of Patent: May 10, 2016

(54) FLAT SCREEN MATERIAL AND PRINTING SCREEN

(71) Applicant: GALLUS FERD. RUEESCH AG, St. Gallen (CH)

(72) Inventors: Heinz Brocker, Herisau (CH); Hans-Rudolf Frick, Herisau (CH)

(73) Assignee: Gallus Ferd. Rueesch AG, St. Gallen (CH)

( * ) Notice: Subject to any disclaimer, the term of this patent is extended or adjusted under 35 U.S.C. 154(b) by 0 days.

(21) Appl. No.: 14/569,991

(22) Filed: Dec. 15, 2014

(65) Prior Publication Data

US 2015/0096451 A1 Apr. 9, 2015

Related U.S. Application Data

(63) Continuation of application No. PCT/EP2013/001723, filed on Jun. 12, 2013.

(30) Foreign Application Priority Data

Jun. 14, 2012 (DE) ..... 10 2012 011 901

(51) Int. Cl.
*B41F 15/34* (2006.01)
*B41N 1/24* (2006.01)

(52) U.S. Cl.
CPC ..... *B41F 15/34* (2013.01); *B41N 1/247* (2013.01)

(58) Field of Classification Search
CPC ..... B41C 1/14; B41C 1/142; B41C 1/147; B41F 15/34; B41N 1/247
See application file for complete search history.

(56) References Cited

U.S. PATENT DOCUMENTS

| | | | | |
|---|---|---|---|---|
| 3,482,300 | A | 12/1969 | Reinke | |
| 3,759,799 | A * | 9/1973 | Reinke | 101/127 |
| 4,285,274 | A | 8/1981 | Katsuuma | |
| 4,397,715 | A | 8/1983 | Mohan et al. | |
| 4,478,688 | A | 10/1984 | De Hek | |
| 4,705,608 | A | 11/1987 | Keller et al. | |
| 5,365,840 | A | 11/1994 | Newman | |
| 6,412,407 | B1 | 7/2002 | Brocker et al. | |
| 2011/0283904 | A1 * | 11/2011 | Brocker et al. | 101/127 |

FOREIGN PATENT DOCUMENTS

| | | | |
|---|---|---|---|
| DE | 69108040 | T2 | 7/1995 |
| EP | 0049022 | A1 | 4/1982 |
| EP | 0182195 | A2 | 5/1986 |
| WO | 9919146 | A1 | 4/1999 |

* cited by examiner

*Primary Examiner* — David Banh
(74) *Attorney, Agent, or Firm* — Laurence A. Greenberg; Werner H. Stemer; Ralph E. Locher

(57) ABSTRACT

A flat screen material for use in screen printing has strands forming a woven screen structure. The strands are arranged at angles to one another and crossing at crossing points, where the strands form undercuts there, and otherwise forming a screen structure with openings and metal deposits, at least at the surfaces thereof, deposited onto the strands in an electroplating process. The undercuts, in the area of crossing points of the strands, at least to some extent have a filling, made of the metal, that has been applied in the electroplating process. The filling, in particular, forms an inner-edge transition with rounding. The fillings improve the properties of the screen material, particularly with regard to stability, through-flow and possible cleaning. A screen for rotary screen printing is made of such a flat screen material.

16 Claims, 10 Drawing Sheets

FLAT SCREEN MATERIAL AND PRINTING SCREEN

CROSS-REFERENCE TO RELATED APPLICATION

This application is a continuation, under 35 U.S.C. §120, of copending international application No. PCT/EP2013/001723, filed Jun. 12, 2013, which designated the United States; this application also claims the priority, under 35 U.S.C. §119, of German patent application No. DE 10 2012 011 901.1, filed Jun. 14, 2012; the prior applications are herewith incorporated by reference in their entirety.

BACKGROUND OF THE INVENTION

Field of the Invention

The invention relates to a screen material. More specifically, it pertains to flat screen material for use in screen printing, in particular in rotary screen printing. The material is formed with strands that are formed into a woven screen structure, arranged at angles to one another and crossing at crossing points, where the strands form undercuts. The strands forming a screen structure with openings and the strands, at the surfaces thereof, having a covering of approximately constant thickness made of metal, in particular nickel, which has been deposited onto the strands in an electroplating process. The invention also pertains to a screen formed of the screen material.

The industrial application of screens and fabrics is known from a variety of technical fields.

In the case of the application in the filtration area, the usual implementation is a square mesh form. This mesh form has been adopted for the printing application. With the available photographic layers and the known application, a sensible image resolution can be achieved only with a large number of "supports." Therefore, fabrics with high mesh numbers are increasingly being used.

In the case of electronic printing, the thinnest possible screens or fabrics with the thinnest possible wire are used in order to ensure a good through-flow of the pastes and to permit the finest image motifs.

In the case of solar cell coating, a high application of paste and a precise and fine image resolution are required; for example for the application of conductor tracks forming current fingers with the least possible concealment of the solar cells, in order thus to ensure a high efficiency of the solar cells.

The screens and fabric types used for electronic printing are very expensive and sensitive to process, so that they are unsuitable for the production of screen printing plates for rotary screen printing. The lack of suitability is also caused by the fact that the screen fabrics in the rotary screen can be clamped only in one direction, namely the cylinder longitudinal axis. By contrast, they can be clamped in two dimensions in the context of flat screen printing.

In rotary screen printing, the ink is transported through the screen by the hydrodynamic pressure which, during the rotation of the screen and when the doctor is thrown on, is produced before the doctor blade. Because of the construction, only open or semi-open doctor systems can be used, so that the dynamic pressure is influenced by many factors, such as viscosity, filling quantity and rotational speed. The hydrodynamic pressure can be intensified simply by increasing the rotational speed or the quantity of ink.

Such a rotary screen printing unit is described, by way of example, in commonly assigned U.S. Pat. No. 6,412,407 B1 and its counterpart international patent application publication WO 99/19146 A1.

According to the prior art, stainless steel fabrics with a linen weave are used as the basic structures for screen materials. The ratio of screen opening, contact area and fabric thickness has proven to be suitable. The thickness of the structure, that is to say the fabric thickness (initial dimension before calendering) corresponds approximately to two times the wire thickness. The basic structure is processed in a further step in a calendering process, also designated a calender process, and is thus brought to the desired untreated fabric thickness. In addition, a higher smoothness of the screen and therefore lower screen and doctor wear are thus achieved. In the subsequent nickel plating operation, the fabric is generally reinforced uniformly, that is to say symmetrically with respect to the axis of the fabric threads, for the purpose of higher wear resistance, and the supporting points in the area of the crossing points are enlarged. However, methods for specific deposition only in one direction, perpendicular to the area of the fabric, are also known. Thus, according to U.S. Pat. Nos. 4,478,688 and 4,397,715 and their counterpart European publication EP 0 049 022 A1, by adapting the flow rate and the addition of chemical additives, a specific deposition of metal is achieved.

A complete method for producing such screen materials is described, for example, in U.S. Pat. No. 4,705,608 and its counterpart European publication EP 0 182 195 A2.

It is known from the prior art that stainless steel fabrics, for example for rotary screen printing, are metalized by way of electroplating methods.

The prior art for the nickel plating is that use is preferably made of sulfamate-nickel baths or chemical-nickel methods (without external power). The advantage of these methods is a uniformly geometric layer distribution in all spatial dimensions. The disadvantage of these methods resides in the fact that, at the crossing point, a so-called angle weakness, also referred to as an undercut, is produced. The undercut has the property that the flow behavior, for example during cleaning processes and of ink during printing, and also the stability of the metalized fabric are affected detrimentally.

It is further known that multiple nickel layers as corrosion protection and/or for decorative purposes are deposited by using Watts nickel sulfate electrolytes. This method can be applied in a wide range of applications in different sectors to finish an extremely wide range of components.

An extremely wide range of different, preferably organic, additives are added to the Watts nickel sulfate baths. The additives are subdivided into gloss additives (so-called carriers) of first (primary) and second (secondary) class. Primary carriers which, furthermore, can also have properties of carriers of second class, are used to achieve a homogeneous deposition of metal with a specific basic gloss over the greatest possible current density range. Secondary carriers influence leveling behavior and level of gloss to a great extent.

Furthermore, the carriers of first and second class in combination have still further effects on the deposited nickel layer: gloss, ductility, hardness, leveling behavior and electrochemical potential of the deposited layers amongst one another.

Mixtures of organic additives that are obtainable on the market must meet a large number of technical requirements. These mixtures and nickel baths are substantially adapted to the metallization of piece parts in drum systems.

For the nickel plating of fabrics, these baths can be used only to a limited extent in reel to reel systems (roll to roll). It is usual during the metallization for the surface to be finished to be turned toward the anode during the metallization process (e.g. by rotation in drum systems).

This, in combination with the addition of additives, permits a uniform layer distribution.

In a reel-to-reel system, this could theoretically be achieved by means of belt guidance between two anodes. However, fabrics, in particular extremely fine fabrics, have the property of expanding extremely quickly because of the input of power and their low mass, which leads to corrugation and internal stresses. In addition, the mixtures listed above are matched in such a way that either an undercut remains at the crossing point or the mesh openings close up to too great an extent.

In order to ensure the stability of the screen material, a close-mesh structure with many supporting points is chosen. These screen materials and screens known from the prior art have the following disadvantages:

At the crossing points of the fabric threads, there are angle weaknesses, that is to say undercuts. In other words: the stability of woven screens is restricted by the notch effect in the area of the crossing points of the fabric threads.

Intensified coating by way of the generally known electroplating coating process is no solution, since the openings of the fabric close up during the process and, when used in screen printing, it is possible for blockage of the openings by ink particles to occur. This then impairs the printing quality.

SUMMARY OF THE INVENTION

It is therefore an object of the present invention to devise a screen material and a screen which do not have the disadvantages of the screen materials and screens known from the prior art and are particularly suitable for rotary screen printing. The screen materials, in particular steel fabrics, should have a higher stability and a longer service life for the application in rotary screen printing.

With the above and other objects in view there is provided, in accordance with the invention, a flat screen material for use in screen printing, in particular in rotary screen printing. The material comprises:

a multiplicity of strands forming a woven screen structure, the strands being arranged at angles relative to one another and crossing one another at crossing points, the strands forming undercuts at the crossing points;

the strands forming a screen structure with openings and the strands having surfaces with an electroplated covering of substantially constant thickness made of a metal (e.g., nickel), the covering having been deposited onto the strands in an electroplating process;

a filling disposed at the crossing points of the strands in the undercuts in addition to the covering, the filling being an electroplated filling of the metal applied in the electroplating process and being formed substantially without sharp edges and chamfers at a surface thereof.

With the above and other objects in view there is also provided, in accordance with the invention, a screen for rotary screen printing, comprising a flat screen material as summarized above formed into a cylindrical sleeve, and coated on one side thereof with a polymer layer. In a preferred embodiment, the polymer layer is a photopolymer layer.

These are particularly advantageous, since they take account of the specific requirements of rotary screen printing and have a greater stability as compared with conventional screen materials and screens. The flat screen material according to the invention is used for the application in screen printing, in particular in rotary screen printing. The screen material has strands arranged at angles to one another and crossing at crossing points, forming a woven screen structure, the invention being independent of the type of weave and the mesh form. At the crossing points, the strands form undercuts, undercuts being understood to mean the inner edges of adjacent surfaces of crossing strands, for example of warp threads and weft threads. These thus have an angle weakness, which is also referred to as an inner-edge weakness. The strands are arranged such that a screen structure having openings is formed. Overall, at the surfaces thereof, the strands have a covering of approximately constant thickness made of metal, in particular nickel, which has been deposited on the strands in an electroplating process. According to the invention, the flat screen material is designed in such a way that, in the area of crossing points of the strands, the undercuts thereof, in addition to the covering, at least to some extent have a filling, made of the metal, that has been applied in the electroplating process. In other words: by means of the electroplating process, the undercuts have been reduced or eliminated by additional metal having been deposited specifically in the area of the undercuts. As a result, a surface without sharp edges and without chamfers is produced.

A flat screen material of this type has the advantage that, as a result of the metallic filling, when the screen material is used for screen printing, flow resistances and turbulences are reduced, which leads to an improved flow behavior of the ink. Furthermore, no printing ink can dry in the undercut. In addition, the cleaning process is further simplified, since a direct inflow of cleaning fluid is made possible, which contributes to a shorter cleaning time and a lower consumption of cleaning liquid. A further advantage is the increased stability of the flat screen material, since the notch effect of the undercuts is reduced by the metallic filling.

In a particularly advantageous and therefore preferred development of the screen material according to the invention, a respective filling forms an inner-edge transition with rounding. The metal filling is therefore implemented in such a way that there are no sharp edges or chamfers in the area of the undercuts. It is particularly advantageous if the fillings have a radius of at least 1 μm or at least one tenth of the average radius of the strands (average of radius of warp threads and radius of weft threads). This ensures that, during the applications in screen printing, the ink can flow through the screen material without difficulty and there are no substantial deposits in the area of the undercuts, the screen material is easy to clean and at the same time exhibits high stability.

In a first design variant of the flat screen material according to the invention, a curve along the surface of the screen material—seen in a section plane perpendicular to the screen material and through one of the strands—describes a smooth curve. Here, a smooth curve is understood to mean a smooth curve in the mathematical sense, i.e. a curve which is continuous and can be differentiated, that is to say a curve without corners or abrupt turns.

In a second design variant of the flat screen material according to the invention, a curve along the surface of the screen material—seen in a section plane parallel to the screen material and through all the strands—describes a smooth curve. Here, a smooth curve is understood to mean a smooth curve in the mathematical sense, i.e. a curve which is continuous and can be differentiated, i.e. a curve without corners or abrupt turns. For the first variant, the undercuts on the upper side and/or on the underside of the screen material each have a metallic filling. For the second variant, on the other hand, the undercuts in the plane of the screen material each have a metallic filling. In an advantageous development, the two design variants are combined with each other, so that a particularly stable flat screen material optimized for through-flow is formed.

In an advantageous development of the flat screen material having smooth curves between two crossing points, the curve along the surface of the screen material has two turning points, wherein the turning points delimit the filling. Here, a turning point is understood to mean a turning point in the mathematical sense, i.e. a point on the surface curve at which a change in sign of the second derivative takes place. Here, the turning points can in particular have a spacing from one another of at least 1 μm and at most a spacing which corresponds to the pitch. Pitch designates the spacing of the mid-axes of two adjacent, mutually parallel strands. In particular, however, the turning points are spaced apart from one another by 10 to 20 μm. Fillings which fall in this area are firstly easy to produce from the point of view of fabrication and secondly fulfill the expectations on higher stability and better through-flow properties of the flat screen material.

In an alternative embodiment to the filling with rounding, a parabolic filling, which in each case itself has an undercut, is provided. In the case of the parabolic filling, the screen material in the area of a respective undercut is particularly thickly filled and reinforced.

In a further alternative embodiment, the fillings are configured in such a way that the surfaces of the fillings on the surface and/or on the underside of the screen material are each located virtually in one plane. In other words: the effect of the metallic filling is that the strands are embedded completely in the metallic filling.

In a development of this screen material or those described previously, the screen material has a screen structure thinned in a calendering process with calendered surfaces. Here, a calendering process, also designated a calender process, is understood to mean a generally rolling process which effects flattening of the screen structure.

Such a calendering process is described, for example, in U.S. Pat. No. 5,365,840 (corresp. to DE 691 08 040 T2).

The flat screen material is formed by a fabric, e.g. by a plastic fabric or a metal wire fabric. The structure has the form of so-called meshes, e.g. of rectangular meshes or square meshes.

The strands consist of metal at the surfaces thereof, nickel being particularly advantageous and therefore preferred. The metal has been deposited onto the strands in an electroplating process.

In order to produce the screen material according to the invention described above, a fabric structure having one or more in particular nickel-containing layers is preferably metalized from only one electrolyte bath, wherein organic additives can specifically be added to the electrolyte bath to reinforce the crossing points. The formation of the nickel layer is influenced further by the fabric on the fabric side facing away from the anode being moved past non-conductive elements, that is to say insulators, which change the field and therefore influence the nickel deposition. During the movement past, the fabric structure rests on the insulator. In addition, the anodes can be arranged in such a way that, over the extent thereof, these have a different spacing from the fabric. Therefore, the nickel layer distribution in the crossing points on the front and rear side of the fabric can be optimized. Here, depolarized pure nickel plates or nickel pellets in baskets can be used as anodes.

By means of such a method and the combination of in-contact nickel plating process, specific metering of brighteners of first and second class and specific inflow by the electrolyte, the streamlines of the electric field can be influenced in such a way that more nickel can specifically be deposited at the crossing points on the fabric side facing away from the anode.

As a result, it is further possible to achieve the situation in which an individual strand of the fabric is nickel-plated eccentrically, wherein more intense coating is also carried out here on the side facing away from the anode.

Given ideal coordination of all the components, the coating can be carried out in a single process step. This is advantageous in particular during the application of thin nickel layers of a few micrometers. If it is necessary for thicker layers over 2 μm to be deposited, then it is advantageous to subdivide the layer application into a plurality of process steps, but it is possible to dispense with different electrolyte baths.

Between the depositions of the individual nickel layers, the fabric can be cleaned intermediately.

As noted above, the invention also relates to a screen for rotary screen printing, which is produced from a flat screen material as described above, and wherein the screen has the form of a cylindrical sleeve.

In an advantageous development of the screen according to the invention, the flat screen material is provided on one side with a polymer layer, in particular with a photopolymer layer, so that imaging by the method known to those skilled in the art is made possible.

The invention described and the described advantageous developments of the invention, in any desired combination with one another, also constitute advantageous developments of the invention.

With regard to further advantages and refinements of the invention that are advantageous from a constructional and functional point of view, reference is made to the sub-claims and to the description of exemplary embodiments, with reference to the appended drawings.

Other features which are considered as characteristic for the invention are set forth in the appended claims.

The above description mentions several prior art disclosures; where necessary for a better understanding of certain details of the invention, the prior publications are herewith incorporated by reference.

Although the invention is illustrated and described herein as embodied in a flat screen material and a printing screen, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
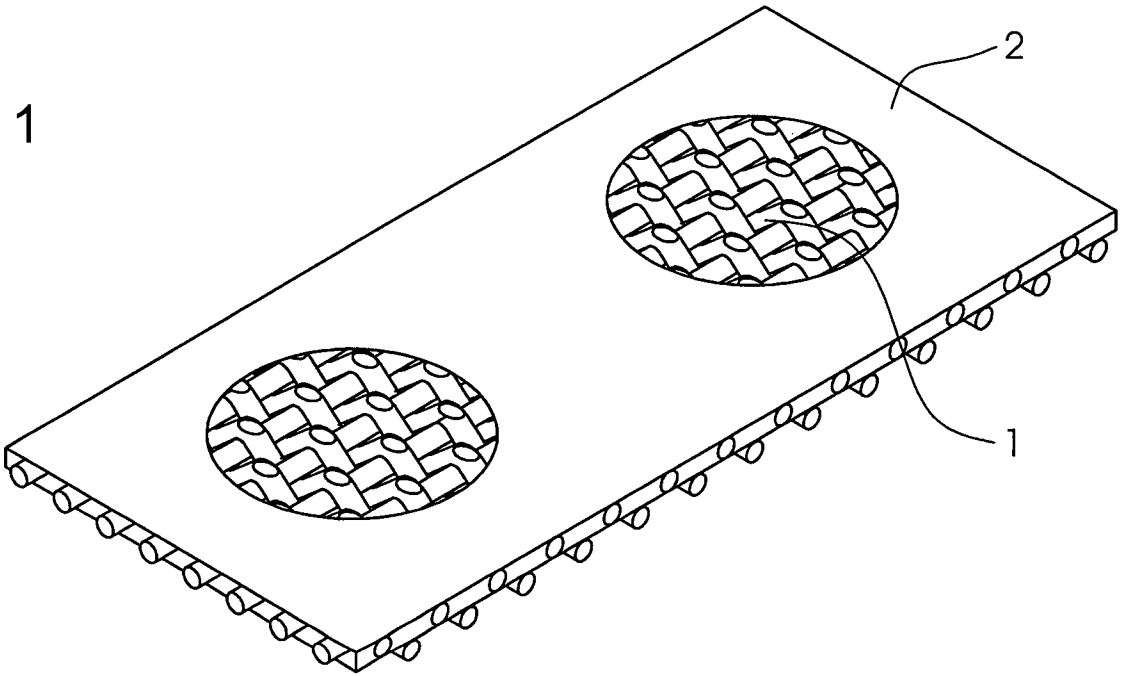
FIG. 1 shows a screen according to the invention.

Reference is now had to the figures of the drawing, where mutually corresponding elements and components are provided with the same designations throughout the figures. In the following text, by way of example, a method for producing the screen material 1 according to the invention and, by way of example, a requisite bath composition will be described. It will be assumed that, during the electroplating, nickel 3 is to be applied to the fabric structure 5.

The base used for the nickel plating can be a Watts nickel electrolyte bath, to which primary and secondary carriers are preferably added:

| |
|---|
| nickel 60-90 g/l |
| chloride 12-45 g/l |
| boric acid 30-50 g/l |
| bath temperature 45-70° C. |
| pH 3.5 to 4.8. |

For the deposition, carriers are preferably added, so-called secondary brighteners, such as butanediol derivatives, quaternary pyridinium derivatives, propargyl alcohol, propynol propoxylate, in particular butanediol, and primary brighteners such as benzenesulfonic acids, alkylsulfonic acids, alylsulfonic acids, sulfonimides, sulfonamides or benzoic acid sulfimide.

Secondary glazing agents are used in this application for the defined reinforcement of the crossing points 10, wherein these are added, depending on the desired reinforcement, with a content of 0 to 0.15 g/l, primary glazing agents between 0 and 8 g/l.

The fabric structure 5, pre-treated as usual in electroplating technology, is nickel-plated by using the bath described above.

The fabric 5 in the nickel bath is transported over an electrically non-conductive supporting surface.

The electrically non-conductive supporting surface can be provided with segments transversely with respect to the transport direction of the fabric 5, the segments likewise being filled with electrolyte during operation and ensuring a permanent exchange of electrolyte.

On the area in contact, the nickel deposition 3 is prevented by electrolyte not being present.

By means of appropriate addition of secondary carriers, the metal deposition 3 is additionally specifically concentrated at the crossing points 10.

In the zone provided with segments, deposition also takes place on the fabric rear side. By means of clever distribution of the segments in relation to the area in contact, combined with the appropriate quantity of secondary carriers, the nickel deposition 3 can be carried out in a manner distributed over the crossing points or the whole of the rear side.

As a result of an ideal flow of electrolyte between anode and the fabric structure as cathode, on the anode side the deposition rate on the fabric is reduced. Given this arrangement, it has been shown that intensified deposition can take place on the side facing away from the anode.

An ideal anode spacing lies between 1 cm and 40 cm with respect to the cathode. This spacing is advantageous inasmuch as fresh electrolyte can still be made to flow onto the fabric 5 with sufficient intensity, but the electric voltage losses as a result of the increased anode spacing remaining at a tolerable level.

The nickel plating can in principle be carried out in a single nickel cell. However, it is also conceivable to arrange a plurality of nickel cells one after another.

Referring now to the figures of the drawing in detail and first, particularly, to FIG. 1 thereof, there is shown a flat screen material 1 according to the invention, which is provided on one side with a photo-polymer coating 2 (direct stencil). In a non-illustrated alternative embodiment, an already imaged film can be applied to the screen structure 1 (indirect stencil). The nickel-plated flat screen material 1 is built up from a fabric in this case.

Figure 2A:
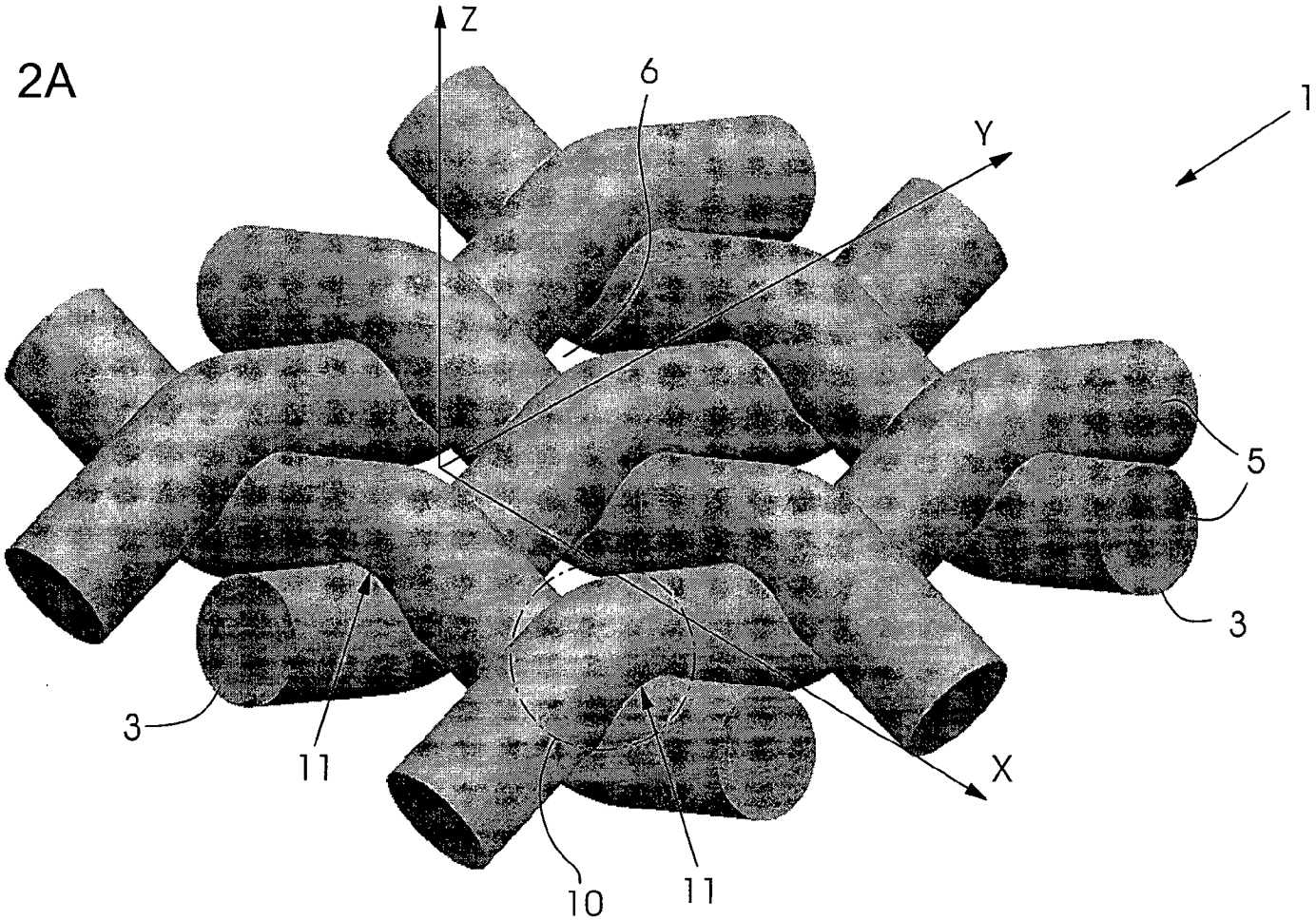
FIG. 2A shows a screen material before nickel plating.

FIG. 2A shows a flat screen material 1 which is formed from interwoven strands 5. Here, the strands 5 are arranged at right angles to one another and spaced apart from one another, so that openings 6 are produced in the flat screen material 1. The area in which the strands 5 arranged at right angles to one another meet or slide on one another is designated a crossing point 10. By means of a metal coating 3, e.g. nickel, which is applied to the strands 5 in an electroplating process, the strands 5 are connected to one another at the crossing points 10. Since the metal coating 3 is applied substantially uniformly to the surface of the strands 5, so-called undercuts 11 are produced where the surfaces of the strands 5 meet one another. In other words: the mutually adjacent surfaces of the strands 5, for example of warp threads 5.1 and weft threads 5.2, form inner edges at the contact lines thereof. This results in an inner-edge weakness, also designated an angle weakness, which has a detrimental effect on stability, through-flow properties and cleaning ability of the flat screen material 1.

In FIG. 2A a Cartesian coordinate system xyz is indicated, the flat screen material 1 lying in the xy plane. The z axis is aligned orthogonally with respect to this plane.

Figure 2B:
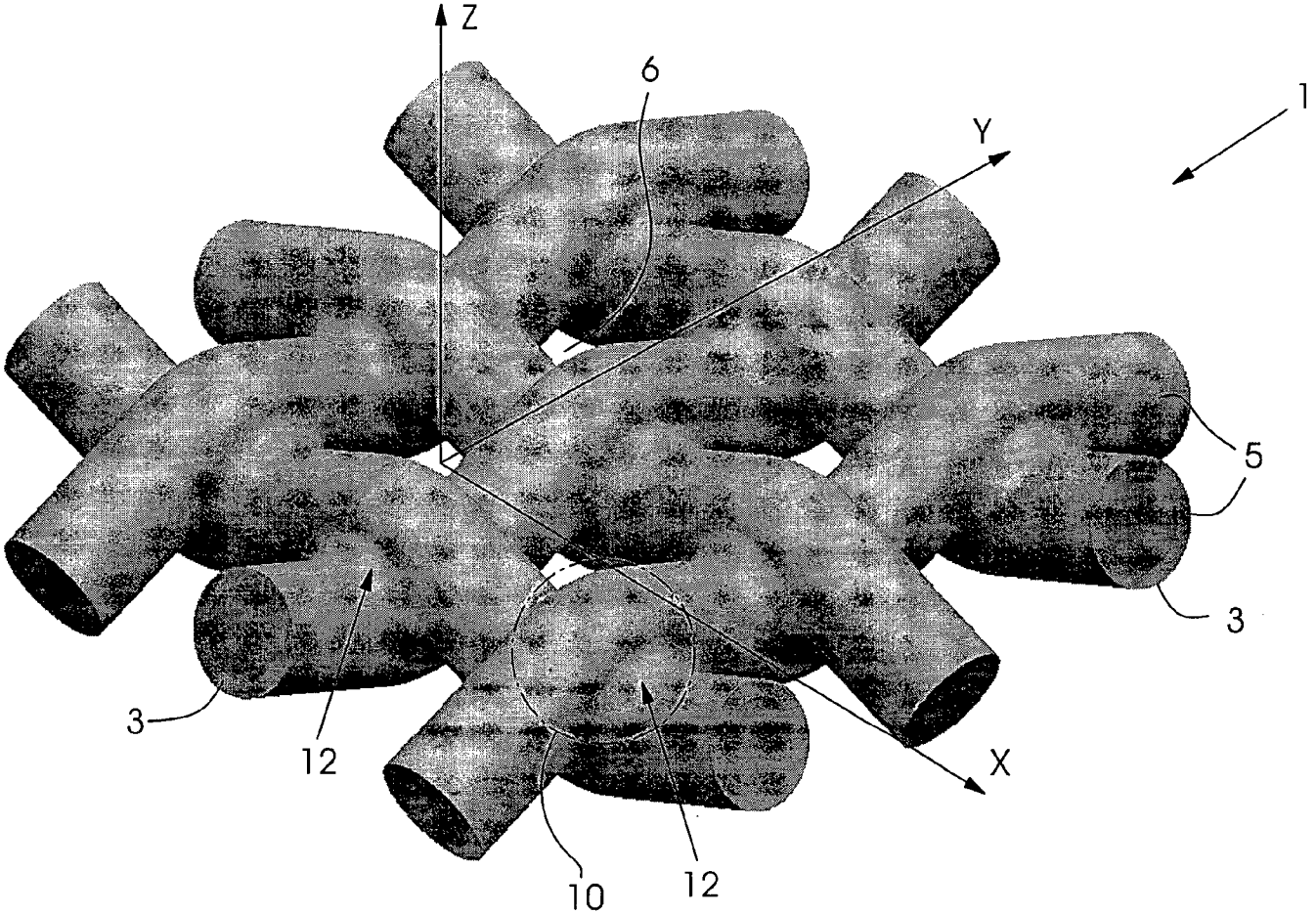
FIG. 2B shows a screen material after nickel plating.

FIG. 2B shows the flat screen material 1 from FIG. 2A. Here, according to the invention, the undercuts 11 at the crossing points 10 are each provided with a filling 12 by means of specific deposition. The specific deposition can be carried out in particular within the context of the production of the metal coating 3 by electroplating. As a result of the filling 12 of the undercuts 11, the properties of the flat screen material 1, in particular with regard to stability, ink through-flow and possible cleaning, are substantially improved.

Figure 3A:
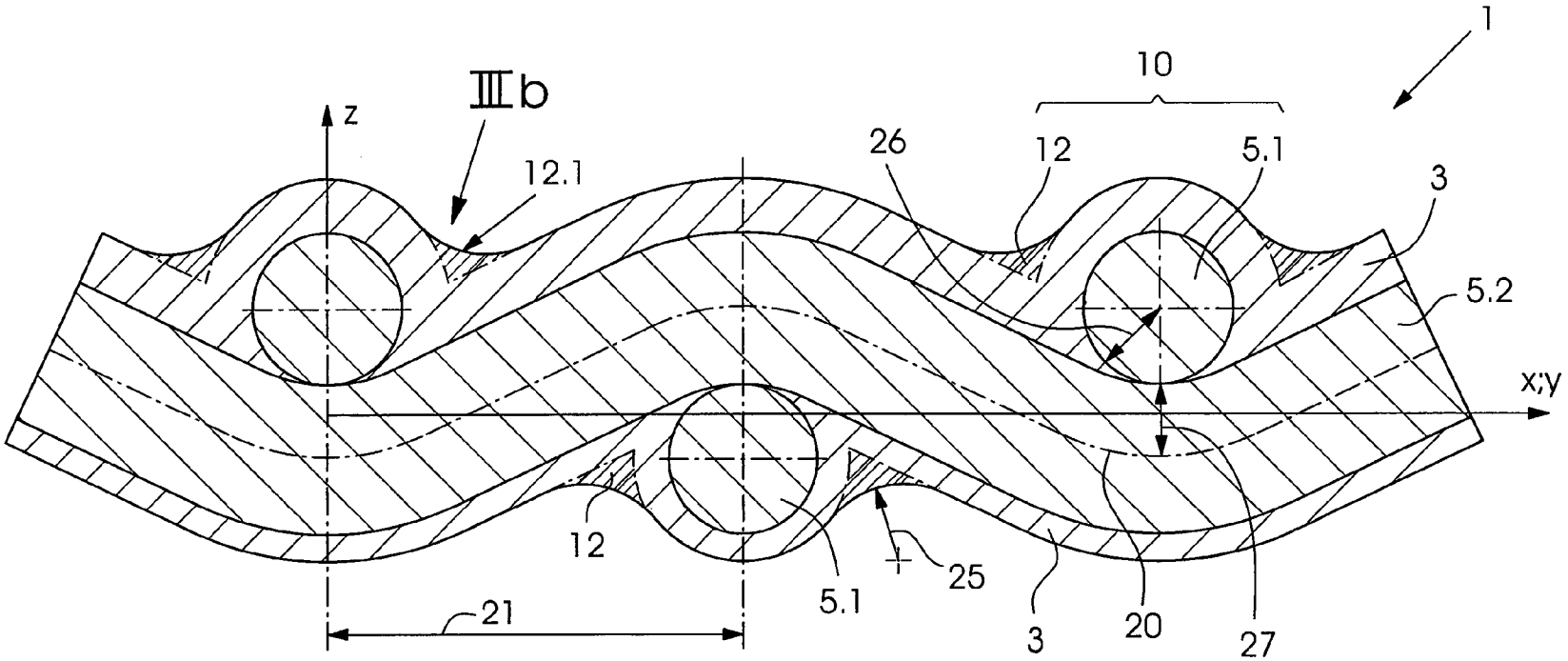
FIG. 3A shows a sectional illustration with a section perpendicular to the screen material.

FIG. 3A shows a section through the flat screen material 1 in the xz plane and in the yz plane, respectively: the warp threads 5.1 and weft threads 5.2 are each provided with the metal coating 3. As indicated in FIG. 3C, the layer thickness of the metal coating a, b, c on the upper surface (upper side 28) and the lower surface (underside 29) of warp threads 5.1 and weft threads 5.2 can be uniform or different. The properties of the flat screen material 1 can be influenced by different layer thicknesses a, b, c of the metal coating 3. In addition, the diameters 26, 27 of warp threads 5.1 and weft threads 5.2 can either be of the same size or different sizes. In addition, in this way an influence can be exerted on the weaving structure and thus on the properties of the flat screen material 1. As further geometric variables, in FIG. 3A the neutral fiber 20 through the wire longitudinal section and the pitch 21, which describes the spacing between two mid-axes of strands 5 (5.1 here), are illustrated. At the crossing points 10, the undercuts 11, which can still be seen in FIG. 3C, according to FIG. 3A have been provided with a filling 12 by specific deposition. This results in an inner-edge transition with rounding 12.1, the rounding having a radius 25. Inner edges, chamfers, cuts and undercuts have been eliminated in this way, and the surface exhibits a smooth transition between the strands 5.

Figure 3B:
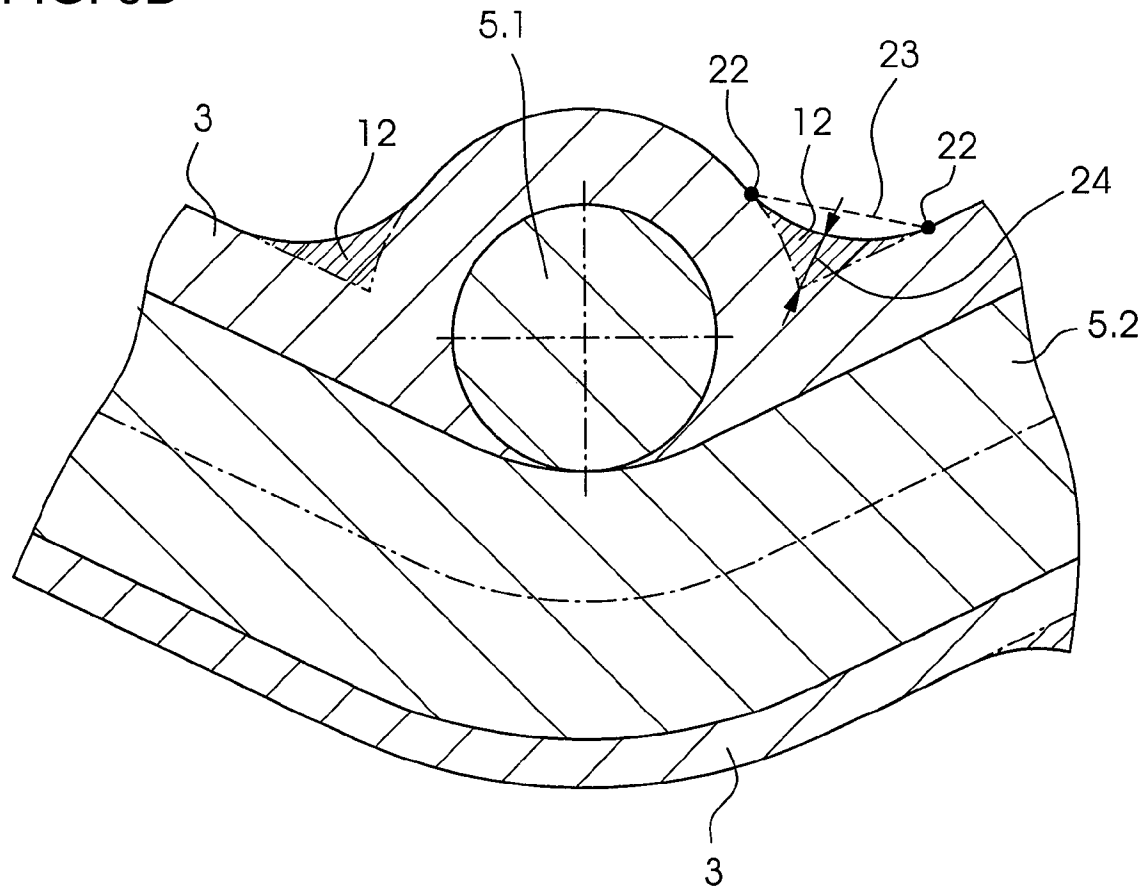
FIG. 3B shows a detail illustration from FIG. 3A.
Figure 3C:
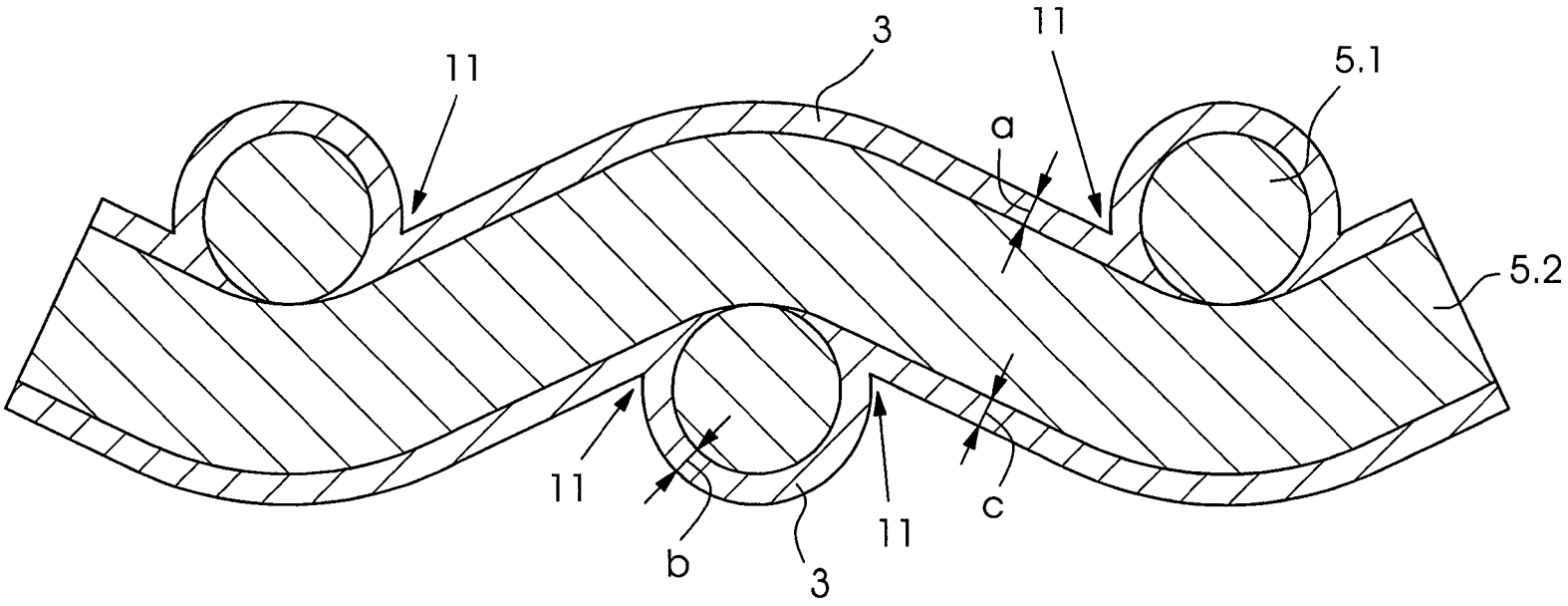
FIG. 3C shows a detail illustration from FIG. 3A before filling.

In the detail illustration of FIG. 3B, the fillings 12 of the undercuts 11 can be seen more clearly: if, in the embodiment according to FIG. 3B, the curve along the surface of the screen material 1 is viewed, then in the area of a respective filling 12 it is possible to see two turning points 22 in each case, these being turning points in mathematical understanding. These turning points 22 are spaced apart from one another with the spacing 23 and delimit the filling 12. Formulated in another way: between the turning points 22 there is a filling 12 of the undercuts 11, outside the turning points 22, on the other hand, the warp thread 5.1 or the weft thread 5.2 is provided with the usual metal coating 3 of layer thickness a, b, c. The filling 12 produced by specific deposition has—approximately centrally between the two turning points 22—the greatest filling thickness 24, which is measured between the surface of the filling 12 and the theoretical vertex of the undercut 11.

Figure 4A:
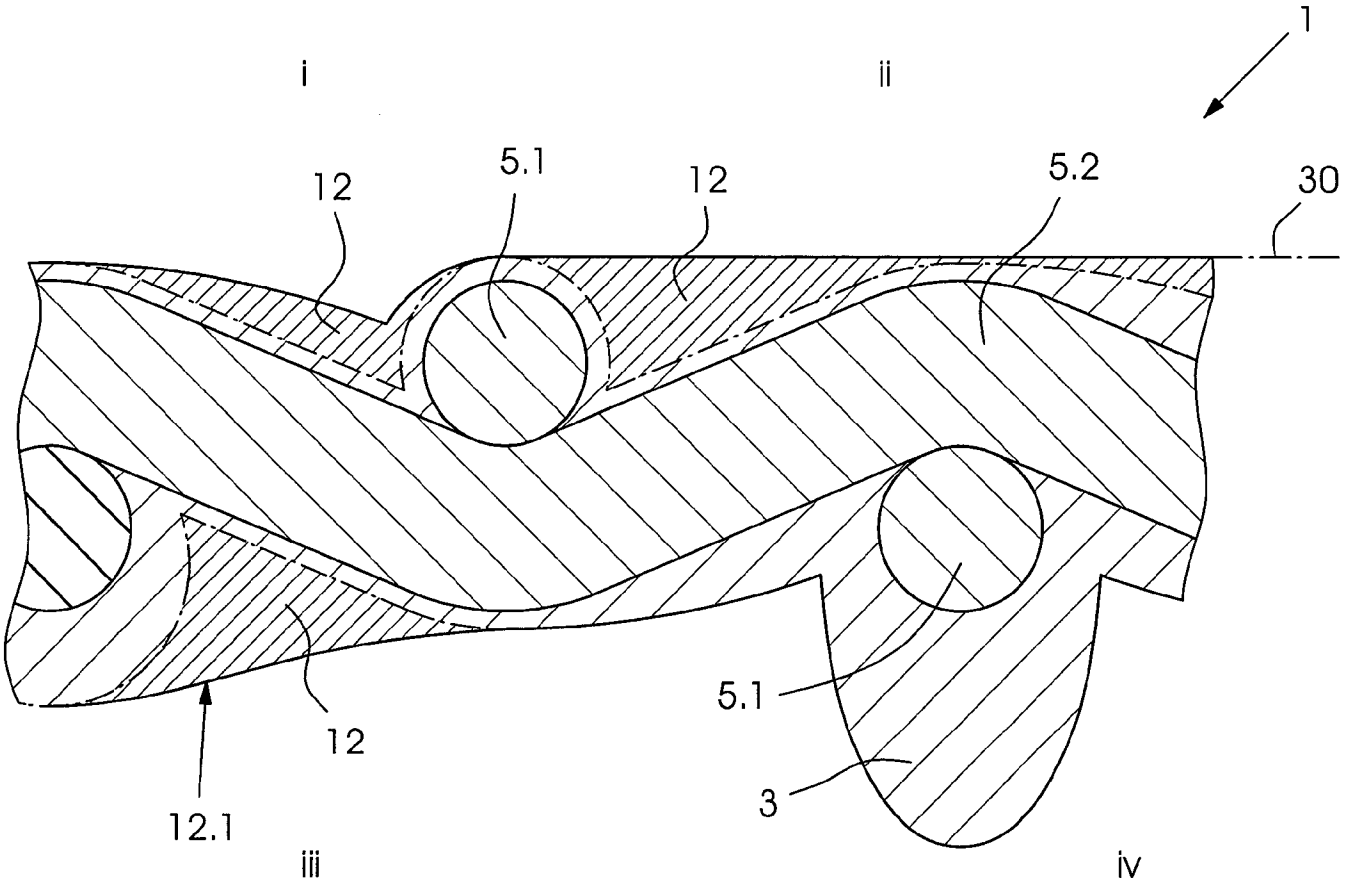
FIG. 4A shows alternative fillings of the undercuts.

In FIG. 4A, alternative electroplated coatings i, ii, iii, iv are shown. According to alternative i, the filling 12 is implemented in parabolic form. Thus, the filling thickness of the filling 12 in the area of the original undercut 11 is particularly great. However, the filling 12 is carried out in such a way that, the filling still has an undercut, and that an inner edge is formed by the filling.

According to alternative ii, a particularly thick electroplated coating has been applied in order for the filling 12 of the undercut 11. The filling 12 is so comprehensive that the surface of the filling 12 lies in the plane 30, and the warp threads 5.1 and the weft threads 5.2 are embedded completely in the metal coating 3, 12. As a result, a flat screen material 1 which has a level surface which lies in the plane 30 is created.

Also according to the variant iii, the undercut 11 has been provided with a particularly thick filling 12. As already also described by using FIG. 3A, the filling 12 has an inner-edge transition with rounding 12.1. As opposed to the embodiment according to FIG. 3A, however, the rounding has a particularly large radius.

The coating alternative iv can be used alternatively or in combination with the coating alternatives described previously. Here, in the area of a respective warp thread 5.1 or weft thread 5.2, intensified metal coating 3 is carried out, so that the metal coating 3 on one side has a particularly high layer thickness, i.e. the coating is applied eccentrically.

Figure 4B:
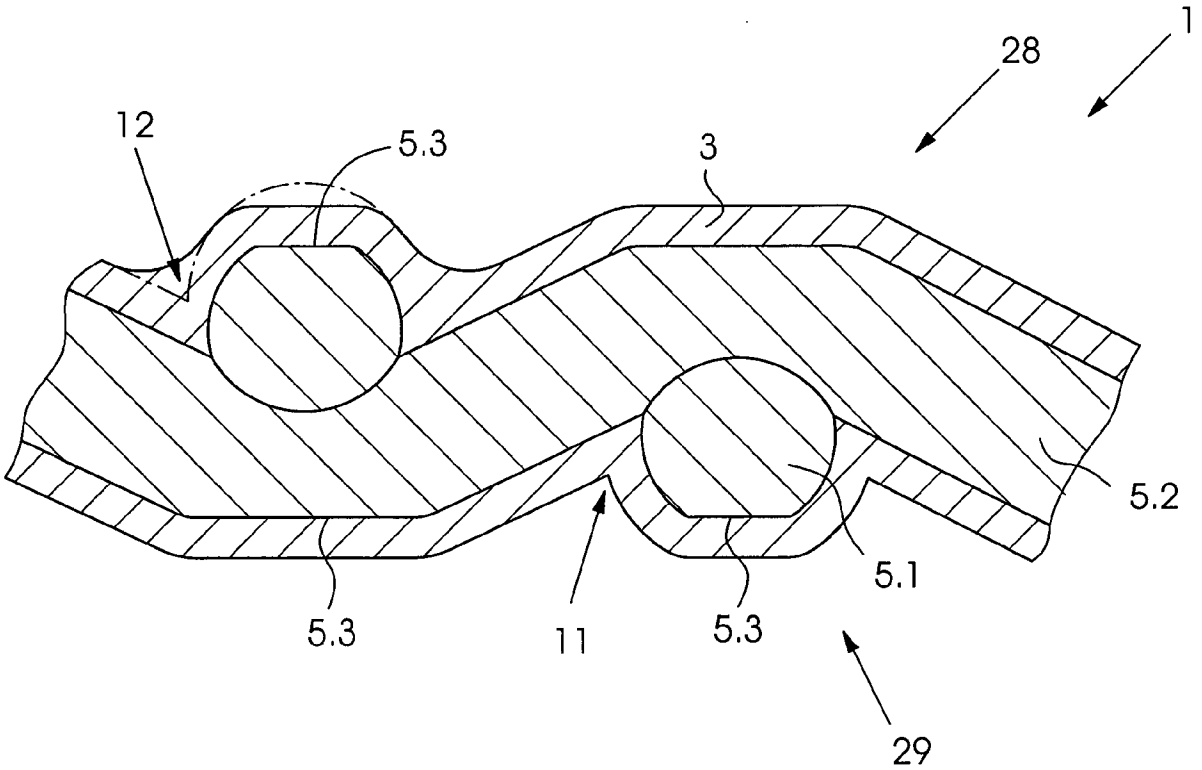
FIG. 4B shows fillings of the undercuts of a calendered fabric.

FIG. 4B shows a highly calendered flat screen material 1. Before the provision of the fabric comprising warp threads 5.1 and weft threads 5.2 with the metal coating 3, the fabric has been rolled and thus flattened. Here, calendered areas 5.3, that is to say flattened areas, have been created. Since, even in the case of a calendered fabric, undercuts 11 in the area of the crossing points 10 result after the metal coating 3, the previously described alternatives to the electroplated coating can be used to the same extent here. As illustrated, the undercuts 11 on the underside 29 of the flat screen material 1 have been left in their original state, while on the upper side 28 of the flat screen material 1 the undercuts 11 have each been provided with a filling 12.

Figure 5:
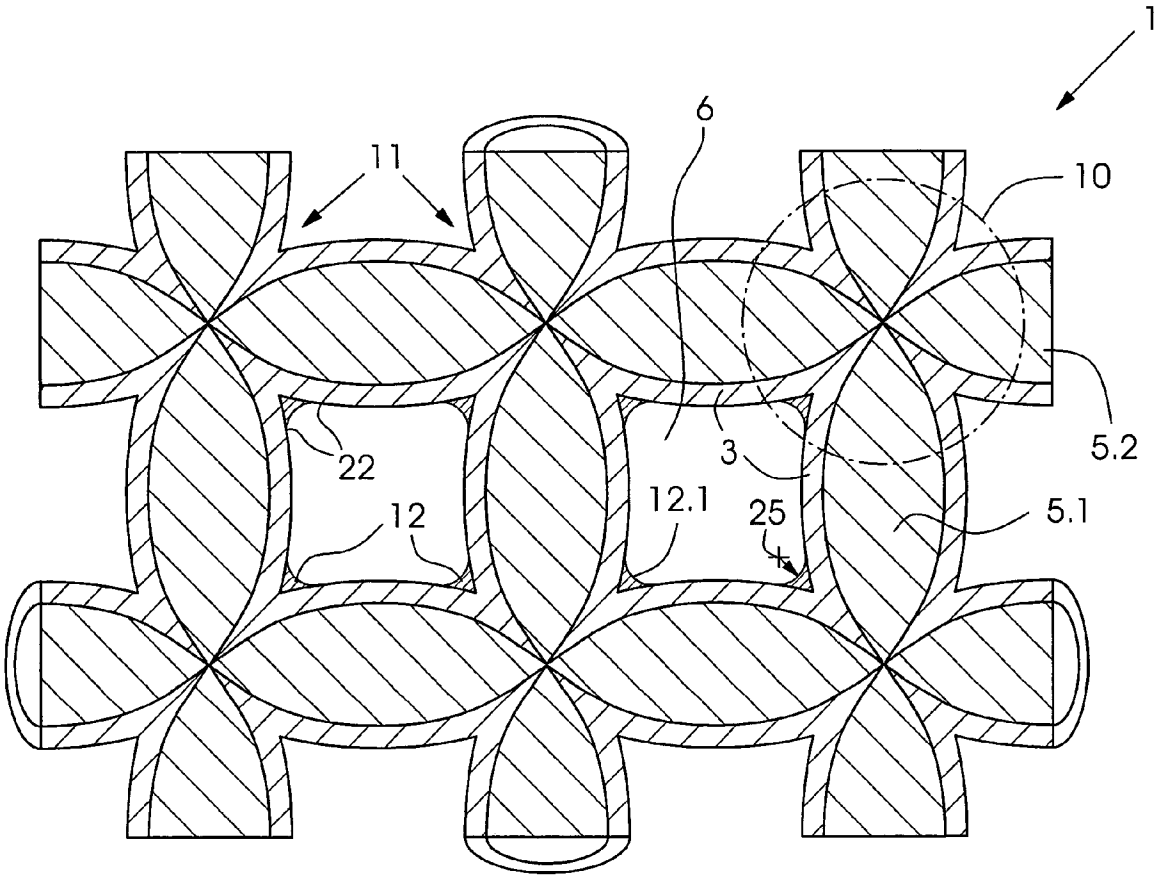
FIG. 5 shows a sectional illustration with a section in the plane of the screen material.

FIG. 5 shows a section through the flat screen material 1 in the xy plane, i.e. in the plane of the flat screen material 1. As illustrated in the upper half of FIG. 5, the flat screen material 1 in the area of the crossing points 10 of warp threads 5.1 and weft threads 5.2 also has undercuts 11 here. These undercuts 11, as described above and illustrated in the lower area of FIG. 5, can likewise be provided with fillings 12, i.e. specific depositions. Here, too, the fillings 12 can have an inner-edge transition with rounding 12.1, wherein the filling 12 can be delimited by two turning points 22 and have a radius 25.

Figure 6:
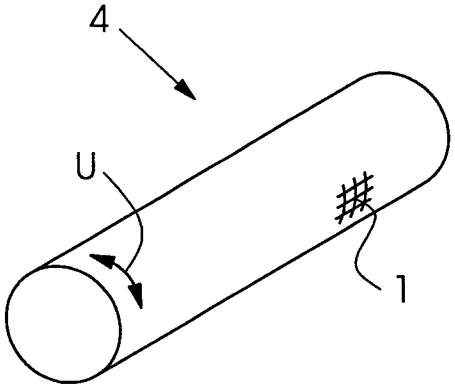
FIG. 6 shows a screen for rotary screen printing.

FIG. 6 indicates a screen 4 having a flat screen material 1 in cylindrical sleeve form for rotary screen printing. Here, the screen material 1 is held in its cylindrical form by end pieces, not specifically designated. In the interior of the screen 4 there is a doctor—not visible here—in order to force ink through the screen material. The orientation of the doctor can be parallel to the axis of rotation of the screen 4. The rotation U of the screen 4 during printing is indicated by a double arrow.

The following is a summary list of reference numerals and the corresponding structure used in the above description of the invention:

1 Flat screen material
2 Polymer coating
3 Metal coating (e.g. nickel)
4 Screen in cylindrical sleeve form
5 Strand
5.1 Warp thread
5.2 Weft thread
5.3 Calendered area
6 Opening
10 Crossing point
11 Undercut
12 Filling (specific deposition)
12.1 Inner-edge transition with rounding
20 Neutral fiber through wire longitudinal section
21 Pitch
22 Turning point
23 Spacing of turning points
24 Filling thickness
25 Radius
26 Radius of warp thread
27 Radius of weft thread
28 Upper side
29 Underside
30 Plane
i, ii, iii, iv Alternative electroplated coatings
x, y, z Axes of a coordinate system
a, b, c Layer thicknesses of the metal coating
U Rotation of the screen

The invention claimed is:

1. A flat screen material for use in screen printing, comprising:

a multiplicity of strands forming a woven screen structure, said strands being arranged at angles relative to one another and crossing one another at crossing points, said strands forming undercuts at said crossing points;

said strands forming a screen structure with openings and said strands having surfaces with an electroplated covering of substantially constant thickness made of a metal, said covering having been deposited onto said strands in an electroplating process;

a filling disposed at said crossing points of said strands in said undercuts in addition to said covering, said filling being an electroplated filling of the metal applied in the electroplating process and being formed substantially without sharp edges and chamfers at a surface thereof;

a curve of a surface of the screen material, as viewed in a section plane perpendicular to the screen material and through one of said strands, describes a smooth curve, said curve of the surface of the screen material between two said crossing points having two turning points, and said turning points delimiting said filling.

2. The flat screen material according to claim 1, wherein the metal is nickel.

3. The flat screen material according to claim 1, wherein the screen material is configured for rotary screen printing.

4. The flat screen material according to claim 1, wherein a respective filling forms an inner-edge transition with rounding.

5. The flat screen material according to claim 1, wherein said filling has a radius of curvature of at least 1 μm or of 1/10 of an average radius of said strands.

6. The flat screen material according to claim 1, wherein said turning points have a spacing from one another of at least 1 μm and at most of a pitch.

7. The flat screen material according to claim 1, wherein said turning points have a spacing of between 10 and 20 μm.

8. A flat screen material for use in screen printing, comprising:

a multiplicity of strands forming a woven screen structure, said strands being arranged at angles relative to one another and crossing one another at crossing points, said strands forming undercuts at said crossing points;

said strands forming a screen structure with openings and said strands having surfaces with an electroplated covering of substantially constant thickness made of a metal, said covering having been deposited onto said strands in an electroplating process;

a filling disposed at said crossing points of said strands in said undercuts in addition to said covering, said filling being an electroplated filling of the metal applied in the electroplating process and being formed substantially without sharp edges and chamfers at a surface thereof;

a curve of a surface of the screen material, as viewed in a section plane parallel to the screen material and through all of said strands, describes a smooth curve, said curve of the surface of the screen material between two said crossing points having two turning points, and said turning points delimiting said filling.

9. The flat screen material according to claim 8, wherein said turning points have a spacing from one another of at least 1 μm and at most of a pitch. 13. The flat screen material according to claim 8, wherein said turning points have a spacing of between 10 and 20 μm.

10. The flat screen material according to claim 8, wherein said turning points have a spacing of between 10 and 20 μm.

11. The flat screen material according to claim 1, wherein the screen material has an upper side and an underside, and each of said undercuts on at least one of said upper side, said underside, or a plane of the screen material has a respective said filling.

12. The flat screen material according to claim 1, wherein the screen material has an upper side and an underside, and wherein surfaces of said filling one or both on said upper side and said underside of the screen material are each located virtually in one plane, and/or the screen material has a screen structure thinned in a calendering process.

13. A screen for rotary screen printing, comprising:

a flat screen material according to claim 1 formed into a cylindrical sleeve; and said screen material being coated on one side thereof with a polymer layer.

14. The screen for rotary screen printing according to claim 13, wherein said polymer layer is a photopolymer layer.

15. The flat screen material according to claim 1, wherein said filling has an inside radius with a radius of curvature of at least 1 μm or of 1/10of an average radius of said strands.

16. A flat screen material for use in screen printing, comprising:

a multiplicity of strands forming a woven screen structure, said strands being arranged at angles relative to one another and crossing one another at crossing points, said strands forming undercuts at said crossing points;

said strands forming a screen structure with openings and said strands having surfaces with an electroplated covering of substantially constant thickness made of a metal, said covering having been deposited onto said strands in an electroplating process;

a filling in addition to said covering, said filling disposed at said crossing points of said strands and deposited specifically in said undercuts for eliminating said undercuts, said filling being an electroplated filling of the metal applied in the electroplating process and being formed substantially without sharp edges and chamfers at a surface thereof;

a curve of a surface of the screen material, as viewed in a section plane perpendicular to the screen material and through one of said strands, describes a smooth curve, said curve of the surface of the screen material between two said crossing points having two turning points, and said turning points delimiting said filling.

* * * * *